United States Patent [19]

Bantien

[11] Patent Number: 4,856,958

[45] Date of Patent: Aug. 15, 1989

[54] APPARATUS FOR CONVERTING DISCRETE ARRAYS OF ROD-SHAPED ARTICLES INTO A MASS FLOW

[75] Inventor: Jürgen Bantien, Hamwarde, Fed. Rep. of Germany

[73] Assignee: Körber AG, Hamburg, Fed. Rep. of Germany

[21] Appl. No.: 31,256

[22] Filed: Mar. 26, 1987

[30] Foreign Application Priority Data

Apr. 10, 1986 [DE] Fed. Rep. of Germany ..... 3612040

[51] Int. Cl.[4] ..... A24C 5/352; A24C 5/356

[52] U.S. Cl. ..... 414/414; 198/347

[58] Field of Search ..... 414/403, 411, 414, 416, 414/422; 198/347, 572

[56] References Cited

U.S. PATENT DOCUMENTS

| | | | |
|---|---|---|---|
| Re. 32,001 | 10/1985 | Wahle | 414/416 |
| 3,305,128 | 2/1967 | Dearsley | 198/347 X |
| 3,355,004 | 11/1967 | Rupert | 198/572 |
| 3,596,787 | 8/1971 | Rowlands et al. | 414/414 |
| 3,651,968 | 3/1972 | Cleland | 414/414 |
| 4,201,507 | 5/1980 | Hinchcliffe et al. | 198/347 X |
| 4,281,670 | 8/1981 | Heitmann et al. | 131/281 |
| 4,531,626 | 7/1985 | Toriyabe et al. | 198/347 |

FOREIGN PATENT DOCUMENTS

| | | | |
|---|---|---|---|
| 2132969 | 7/1984 | United Kingdom | 198/347 |

*Primary Examiner*—David A. Bucci
*Attorney, Agent, or Firm*—Peter K. Kontler

[57] ABSTRACT

Apparatus for converting discrete block-shaped arrays of parallel cigarettes into a continuous mass flow of cigarettes has an elevator which receives discrete arrays from individual trays while in a raised position and which thereupon deposits a freshly received array on the mobile bottom wall in the compartment of a magazine having upright front and rear walls which are movable independently of each other. The compartment receives one array at a time. A conveyor adjacent the front wall of the magazine carries the trailing end of the mass flow, and the array in the compartment can be added to the trailing end of the mass flow in response to movement of the front wall transversely of the direction of transport of the mass flow. At such time, the bottom wall and the rear wall of the magazine are moved forwardly to expel the array from the magazine. The front wall is then returned to its normal position and the rear wall is retracted to provide room for delivery of a fresh array into the magazine. The quantity of cigarettes on the conveyor outside of the magazine is monitored and the signals which are generated by the monitoring means are used to control the operation of the elevator, of the bottom wall and front and rear walls of the magazine, and of a conveyor which receives cigarettes from the front end of the mass flow and delivers them to a processing machine.

17 Claims, 3 Drawing Sheets

APPARATUS FOR CONVERTING DISCRETE ARRAYS OF ROD-SHAPED ARTICLES INTO A MASS FLOW

BACKGROUND OF THE INVENTION

The invention relates to improvements in apparatus for manipulating rod-shaped articles of the tobacco processing industry, and more particularly to improvements in apparatus for converting discrete arrays of parallel filter rod sections, plain or filter cigarettes, cigars, cigarillos, cheroots, stogies and like smokers' products into a continuous mass flow of articles wherein the articles form several layers without any transverse partitions between them and are moved, either intermittently or continuously, to one or more processing stations.

An apparatus which is used for the same purpose is disclosed in commonly owned U.S. Pat. No. Re 32,001 granted Oct. 8, 1985 to Wahle. The patented apparatus has a mobile conveyor including a series of walls which are movable to and from upright positions and are advanced stepwise beneath an evacuating station where the compartment between two neighboring walls receives an array of rod-shaped articles from an inverted container of the type known as charger or tray. The compartment is dimensioned to receive an array in such a way that the configuration of the array remains unchanged. The conveyor is then set in motions and the wall in front of the articles of the transferred array is moved out of the way so that the articles on the conveyor can be added to the trailing end of a mass flow consisting of previously transferred articles. The patented apparatus operates quite satisfactorily, however, the mechanism for transporting the walls is rather bulky, complex and expensive.

OBJECTS AND SUMMARY OF THE INVENTION

An object of the invention is to provide an apparatus which can manipulate arrays of parallel rod-shaped articles without any, or practically without any, misalignment of articles during transfer from successive chargers or trays to positions at the trailing end of a continuous mass flow of such articles.

Another object of the invention is to provide a novel and improved magazine for temporary storage of arrays upon their evacuation from trays.

A further object of the invention is to provide an apparatus which constitutes a greatly simplified and more compact version of the apparatus which is disclosed in the aforediscussed patent to Wahle.

An additional object of the invention is to provide the apparatus with novel and improved means for delivering arrays into and for removing arrays from the aforementioned magazine.

A further object of the invention is to provide an apparatus which can accept arrays of rod-shaped articles of the tobacco processing industry from existing trays and which can satisfy the requirements of one or more intermittently or continuously operated processing machines.

Still another object of the invention is to provide a novel and improved method of manipulating rod-shaped articles of the tobacco processing industry on their way from individual trays to one or more processing machines, such as cigarette packing or filter tipping machines.

A further object of the invention is to provide an apparatus which treats the articles gently and whose operation can be automated to any desired extent.

One feature of the invention resides in the provision of an apparatus for converting a succession of individual arrays of parallel rod-shaped articles of the tobacco processing industry (wherein each array has a predetermined length and height) into a continuous mass flow or stream. The apparatus comprises a magazine having upright front and rear walls and a bottom wall which defines with the front and rear walls a compartment having a length corresponding to the predetermined length of an array and a height which at least matches the predetermined height of an array, elevator means which is movable between a upper position above and a lower position at the level of the bottom wall, trays or analogous means for delivering successive arrays of parallel rod-shaped articles to the elevator means in the raised position of the elevator means, transporting means for supporting the mass flow adjacent the front wall of the magazine and for advancing the mass flow in a predetermined direction away from the magazine, first drive means for moving the front wall substantially transversely of the predetermined direction between extended and retracted positions so that an array in the compartment constitutes the trailing end of the mass flow on the transporting means in response to movement of the front wall to its retracted position, and second drive means for moving the rear wall in the predetermined direction independently of the front wall. This enables the rear wall to push an array out of the magazine while the front wall is held in the retracted position. Of course, the elevator means is moved back to its raised position before the array is expelled from the compartment of the magazine.

The transporting means preferably includes a circulating first conveyor which can constitute or include the bottom wall of the magazine, and a second conveyor which can include a stationary table for the mass flow, which is outwardly adjacent the front wall of the magazine and over which the mass flow can be pushed by the rear wall when the latter is caused to move in the predetermined direction.

Signal generating means can be provided to monitor the quantity of articles on the second conveyor. Signals which are generated by the monitoring means can be used to operate the first conveyor (i.e.,the second drive means), to operate the first drive means, to operate the elevator means and/or to operate a removing conveyor means which is provided to receive articles of the mass flow from the transporting means for delivery to one or more processing machines.

The second drive means preferably comprises means for moving the rear wall of the magazine in parallelism with the direction of transport of articles by the first conveyor, preferably back and forth in and counter to the predetermined direction. The rear wall can be separably or more or less permanently mounted on the first conveyor, and the second drive means then comprises means for moving the first conveyor back and forth in and counter to the predetermined direction. The first conveyor can constitute or include at least one endless belt conveyor, and the apparatus further comprises drive means for the belt conveyor or conveyors; such drive means can include or constitute one of the first and second drive means, particularly the second drive means. The first drive means can include means for pivoting the front wall between its extended and retracted positions.

It is presently preferred to provide the apparatus with means for regulating the operation of the elevator means, first and second drive means and transporting means in a predetermined sequence so that the first drive means moves the front wall to the retracted position when the elevator means and an array thereon assume their lower positions and that the transporting means thereupon advances the array from the compartment simultaneously with operation of the second drive means to move the rear wall in the predetermined direction and to thereupon move the rear wall counter to the predetermined direction after the rear wall reaches a foremost position coinciding with or being close to the extended position of the front wall. Such regulating means preferably further comprises means for operating the first drive means so as to return the front wall to its extended position when the rear wall reaches its foremost position.

The trays of the delivering means can be provided with retractible or extractible bottoms so that an array on a bottom can be transferred onto the elevator means in response to retraction or extraction of the bottom in the upper position of the elevator means.

As mentioned above, the delivering means can include trays or chargers each of which contains an array of parallel rod-shaped articles, such as plain or filter cigarettes, cigars, cigarillos, cheroots, stogies or filter rod sections.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DECRIPTION OF THE DRAWING

DESCRIPTION OF THE PREFERRED EMBODIMENTS

Figure 1:
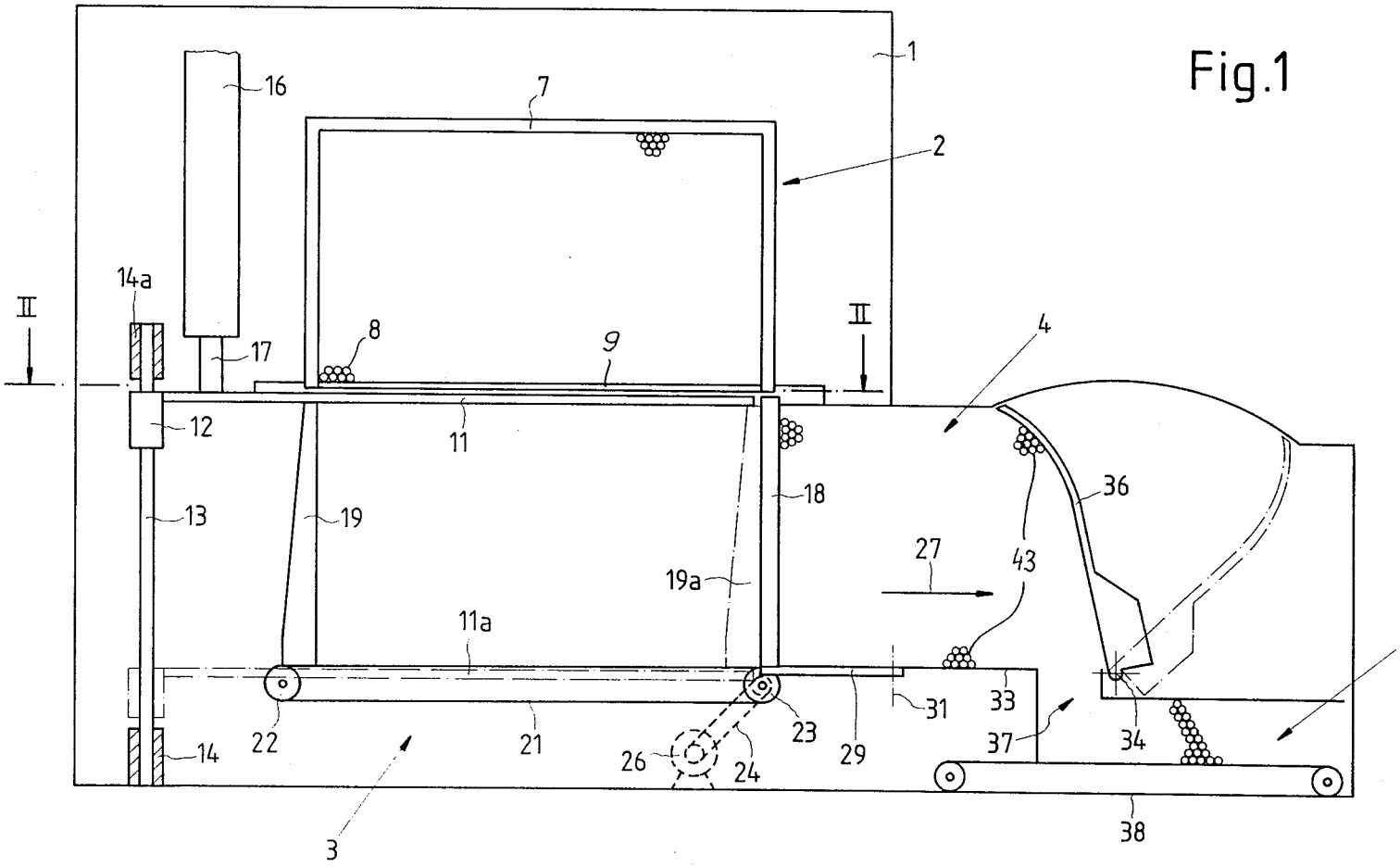
FIG. 1 is a schematic elevational view of an apparatus which embodies one form of the present invention, the elevator means being shown in the raised position and the front wall of the magazine being shown in extended position.
Figure 2:
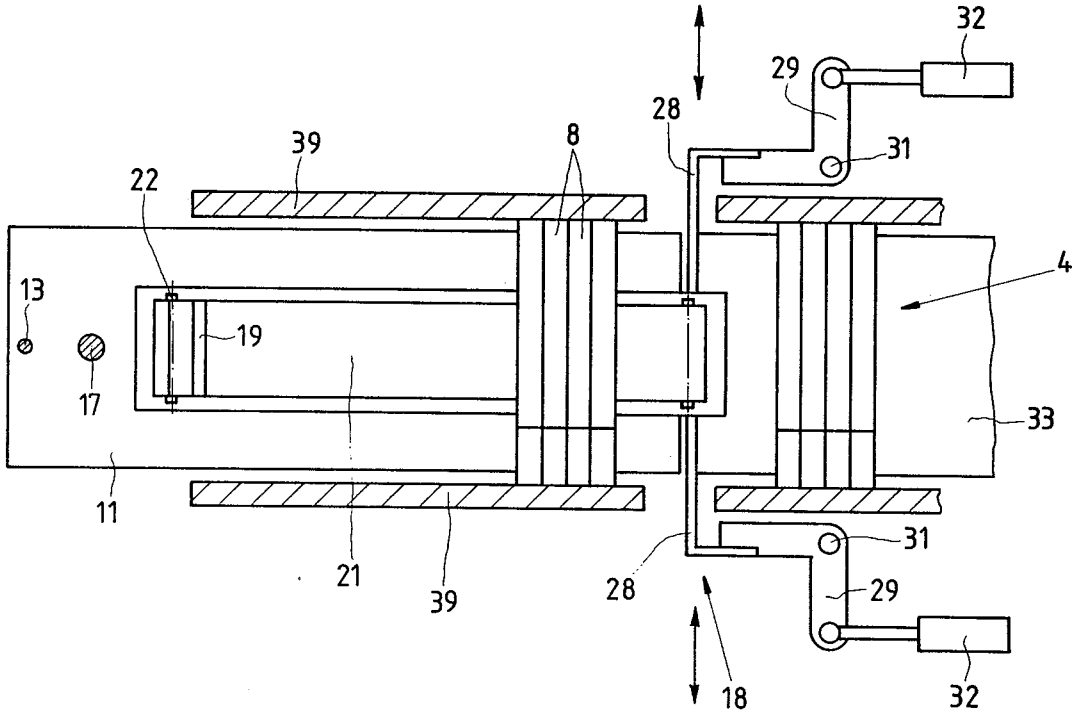
FIG. 2 is a fragmentary horizontal sectional view as seen in the direction of arrows from the line II—II in FIG. 1.

Referring first to FIGS. 1 and 2, there is shown an apparatus which converts a succession of discrete arrays of parallel rod-shaped articles 8 (hereinafter called cigarettes) into a continuous mass flow 43 of cigarettes for transport to one or more processing or consuming machines 44 (FIG. 3), for example, to one or more filter tipping machines of the type known as MAX or MAX S (manufactured by the assignee of the present application and described in numerous United States patents, reference may be had, by way of example, to U.S. Pat. No. 4,281,670 granted Aug. 4, 1981 to Heitmann et al.).

The apparatus comprises a frame or housing 1 which defines an evacuating station 2 for a succession of discrete chargers or trays 7 serving as a means for delivering block-shaped arrays of cigarettes 8 onto an elevator 11 which is movable n the frame 1 between the raised position of FIG. 1 and a lower position 11*a* in which the lowermost layer of cigarettes 8 on the elevator is located close to or at the level of the upper reach of an endless belt conveyor 21. The conveyor 21 constitutes the bottom wall of a magazine 3 which is installed in the frame 1 beneath the evacuating station 2 and further comprises a normally upright front wall 18 and an upright rear wall 19. The terms "front" and "rear" are used to denote the mutual positions of the walls 18 and 19 as seen in the direction (arrow 27) of intermittent or continuous movement of the mass flow 43 away from the magazine 3.

The conveyor 21 further forms part (first conveyor) of a transporting unit 4 which serves to support the mass flow 43 as well as to advance the mass flow in the direction of arrow 27, namely into the range of a removing conveyor means 6 which delivers the cigarettes 8 to the processing machine or machines 44. The illustrated removing conveyor means 6 comprises one or more endless belt conveyors 38.

The tray 7 is shown in FIG. 1 in inverted position so that its contents (i.e., a block-shaped array of cigarettes 8) rest on an extractible or retractible wall 9 which constitutes a cover or lid in non-inverted position of the tray. The elevator 11 comprises a horizontal platform which is immediately adjacent the bottom 9 of the tray 7 thereon so that the cigarettes 8 which form the array on the elevator must descend by gravity through a very short (actually negligible) distance when the bottom 9 is retracted so as to effect the transfer of the array from the tray 7 onto the platform. The bottom 9 can comprise (in the customary way) one or more thin or very thin panels made of sheet metal or other suitable material and movable in a plane extending at right angles to the plane of FIG. 1 between a operative position beneath the array of cigarettes 8 in the inverted tray and a retracted or inoperative position. The arrangement is such that the configuration of the array of cigarettes 8 does not change at all, or changes only negligibly, when the bottom 9 is retracted to effect the transfer of the array onto the platform of the elevator 11. The latter is thereupon caused to descend with the array thereon, while the inverted tray 7 continues to dwell in the position of FIG. 1, so that the array is lowered into the compartment which is defined by the walls 18, 19 and 21 of the magazine 3. The thus emptied tray 7 is then transported away (e.g., in a manner as disclosed in the aforementioned reissue patent to Wahle) to be replaced with a fresh (loaded) tray. The patent to Wahle discloses trays wherein the bottoms (corresponding to the bottom 9 of the tray 7 shown in FIG. 1) are movable in the longitudinal direction of the trays (i.e., to the right or to the left, as seen in FIG. 1). However, it is equally within the purview of the invention to employ trays or analogous containers wherein the bottom walls are movable sideways, i.e., in the axial direction of the articles therein and toward or away from the observer of FIG. 1.

The drive means for moving the elevator 11 up and down during certain stages of operation of the apparatus includes one or more fluid-operated (e.g., hydraulic) cylinder and piston units 16 each having a vertically reciprocable piston rod 17 which is affixed to the platform of the elevator. The platform of the elevator 11 is further secured to a sleeve-like bearing element 12 which is slidable along a vertical guide rod 13 having its upper and lower end portions secured to the frame 1 by means of suitable coupling devices 14 and 14*a* as shown in the left-hand portion of FIG. 1. The raised position of the platform of the elevator 11 is shown in FIG. 1 by solid lines, and the lower end position of such platform is shown by phantom lines at 11*a*. The cylinder or cylinders of the drive means 16 for the elevator 11 are mounted in the frame 1.

It is clear that the illustrated unit 16 constitutes but one form of drive means for the elevator 11. For example, the elevator 11 can be moved between raised and lower positions by a reversible electric motor through the medium of a rack-and-pinion drive, a belt transmission, a chain transmission or the like without departing from the spirit of the invention.

The belt conveyor 21 (i.e., the bottom wall of the magazine 3 and the first conveyor of the transporting unit 4) is trained over an idler pulley 22 and a driver pulley 23. The drive means for the pulley 23 (and hence for the conveyor 21) comprises a variable-speed reversible electric motor 26 which transmits torque to the pulley 23 through the medium of a belt or chain transmission 24. Though it is possible to provide discrete drive means for the rear wall 19, it is presently preferred to mount the wall 19 on the upper reach of the conveyor 21 so that the drive means 26 can move the conveyor 21 and the wall 19 as a unit in or counter to the direction (arrow 27) of transport of the mass flow 43 on the transporting unit 4. It will be seen that the directions of reciprocatory movement of the rear wall 19 are parallel with the directions of movement of the upper reach of the conveyor 21, i.e., of that reach which supports an array of cigarettes 8 that have been deposited thereon by the platform of the elevator 11. The conveyor 21 can comprise a number of endless belts whch are disposed in parallel vertical planes, and the platform of the elevator 11 can have a number of parallel strips or bars which can move through the gaps between neighboring endless belts of the conveyor 21 so that the platform can descend to the position (11*a*) at a level below the upper reach of the conveyor 21. Such mode of cooperation between a platform and several belt conveyors is well known in the art of conveyors. However, it is presently preferred to use an elevator 11 with a U-shaped platform which surrounds three sides of the conveyor 21 and can carry the ends of the cigarettes 8 in a manner as shown in FIG. 1.

The drive means for moving the front wall 18 transversely of the direction which is indicated by the arrow 27 between the extended position of FIG. 1 (in which the wall 18 is located between the rear end of the mass flow 43 on a conveyor or table 33 of the transporting unit 4 and the array of cigarettes 8 in the compartment of the magazine 3) and a retracted positon comprises two fluid-operated (e.g., hydraulic) motors 32. The illustrated front wall 18 comprises two substantially L-shaped sections 28 which are mirror symmetrical to each other with reference to a vertical plane between them and are preferably pivotably mounted on bell crank levers 29. The levers 29 are pivotable about vertical axes which are defined by two discrete fulcra 31 and are set in motion in response to operation of the respective motors 32. The sections 28 of the front wall 18 are disposed in a common plane adjacent the driver pulley 23 for the endless belt or belts of the conveyor 21 at opposite sides of the path which is defined by transporting unit 4 for the mass flow 43. The illustrated drive means 32 for the sections 28 of the front wall 18 has been shown only by way of example because it is possible to employ a variety of other equally satisfactory or more satisfactory drive means. For example, the drive means for the front wall can include a single hydraulic, pneumatic, electric or other motor which can pull or push a one-piece front wall across the path of movement of the mass flow 43 toward the removing conveyor means 6. Alternatively, the drive means for the front wall can include two motors each of which is designed to reciprocate one of two sections of a composite front wall at right angles to the direction which is indicated by the arrow 27. All that counts is to ensure that the drive means is designed to move the front wall substantially transversely of the direction of advancement of the mass flow 43 rather than in or counter to the direction which is indicated by the arrow 27.

The stationary table 33 can be said to constitute or form part of a second conveyor of the transporting unit 4 and supports the mass flow 43 from below in such a way that the lowermost layer of the mass flow is pushed by the array which is in the process of being expelled from the compartment of the magazine 3 as well as by the rear wall 19 which shares the movements of the conveyor 21 and then advances from the illustrated rearmost position of FIG. 1 to a foremost position 19*a* in or close to the plane of the front wall 18.

The apparatus further comprises means for monitoring the quantity of cigarettes 8 in the mass flow 43, and more particularly the quantity of cigarettes on the table 33 of the transporting unit 4. The monitoring means comprises a hood-shaped sensor 36 which is pivotable by the cigarettes 8 of the advancing mass flow 43 and whose angular position is monitored by one or more photoelectronic detectors or the like, not shown, The pivot 34 for the sensor 36 is adjacent a channel 37 wherein the leader of the mass flow 43 advances from the table 33 onto the upper reach of the belt conveyor 38 forming part of the removing conveyor means 6.

The magazine 3 or the frame 1 further comprises sidewalls 39 (shown in FIG. 2) which are adjacent the respective ends of cigarettes 8 forming the array in the compartment of the magazine 3.

Figure 3:
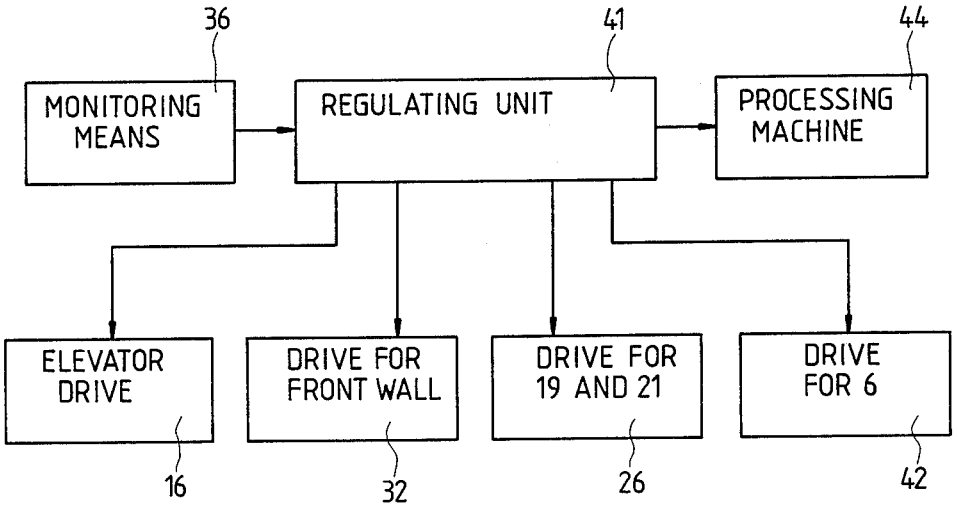
FIG. 3 is a diagram of the means for regulating the operation of the elevator means, the movements of the front and rear walls of the magazine, and the operation of means for transporting the mass flow.

FIG. 3 shows schematically a regulating unit 41 which receives signals from the monitoring means including the sensor 36 and utilizes such signals to control the operation of the drive means 16 for the elevator 11, of the drive means 32 for the front wall 18 of the magazine 3, of the drive means 26 for the rear wall 19 and bottom wall or conveyor 21 of the magazine 3, and of the drive means 42 for the removing conveyor means 6. The exact details of the regulating unit 41 (which can be programmed to control the operation of various drive means, as well as the delivery of trays 7 to the evacuating station 2 and the extraction of bottoms 9 of trays 7 at the station 2) form no part of the present invention. The regulating unit 41 further comprises signals from the processing machine 44; such signals denote whether or not the machine 44 requires fresh cigarettes 8.

The mode of operation of the improved apparatus is as follows:

When a filled tray 7 (with its bottom 9 in operative or closed position) is delivered to the evacuating station 2 in inverted position, the platform of the elevator 11 is kept in the raised position and is immediately adjacent the bottom 9 of the tray. The bottom 9 is thereupon extracted (preferably in response to a suitable signal from the regulating unit 41 (so that the cigarettes 8 of the array in the inverted tray 7 descend onto the platform of the elevator 11 and are ready to be lowered into the compartment of the magazine 3. As mentioned above, the bottom 9 of the tray 7 is so thin that the distance through which the cigarettes 8 must descend onto the platform of the elevator 11 is negligible and such descent does not adversely affect the shape of the array of cigarettes, i.e., the shape remains the same as in the interior of the tray. Nevertheless, it is possible (if necessary) to design the trays 7 in such a way that the lowermost cigarettes of the array in the inverted tray 3 at the station 2 need not descend at all during transfer onto the elevator 11. This can be readily achieved by designing the bottom 9 in such away that it fits into the space between the web and the legs of the U-shaped platform of the elevator 11 so that the platform can be lifted into contact with the lowermost layer of cigarettes 8 in the inverted tray 3 before the bottom 9 of such tray is retracted.

In the next step, the regulating unit 41 transmits a signal to the drive means 16 to initiate a movement of the elevator 11 to the lower position 11*a* whereby the array descends with the platform and enters the compartment of the magazine 3. The length of this compartment (as measured in the direction of the arrow 27), namely the distance between the plane of the front wall 18 and the rear wall 19 (when the wall 19 assumes the rearmost position of FIG. 1) equals the length of the array in a tray 7, and the height of the compartment at least equals the height of an array so as to ensure that the array can enter the compartment while resting on the descending platform of the elevator 11 and the orientation and distribution of its cigarettes 8 remains at least substantially unchanged. As explained above, the lowermost layer of cigaretes 8 in the array which descends with the platform of the elevator 11 can be deposited on the upper reach of the conveyor 21 without any gravitational descent of cigarettes from the platform onto the conveyor 21. The walls 18 and 19 ensure that the length of the descending array remains unchanged and, therefore, that the height of the descending array also remains unchanged and does not exceed the height of the compartment in the magazine 3. It will be seen that an array of cigarettes 8 can be transferred from an inverted tray 7 first onto the platform of the elevator 11 and thereupon onto the conveyor 21 of the magazine 3 and transporting unit 4 without any, or without any appreciable, change in the shape of the array.

The front wall 18 of the magazine 3 constitutes a prop for the rearmost portion of the mass flow 43 on the table 33 of the transporting unit 4. When the elevator 11 reaches the lower position 11*a* of FIG. 1, the regulating unit 41 transmits a signal to the drive means 32 for the front wall 18 so that the sections 28 of such front wall are moved apart by pivoting with the respective levers 29 about the axes of the corresponding fulcra 31 (at the same time, the panels or sections 28 can pivot relative to the respective levels 29) so that the wall 18 assumes its retracted position and the array in the compartment of the magazine 3 then constitutes the rearmost portion of the mass flow 43. The thickness of the sections 28 of the front wall 18 is minimal or negligible so that extraction of the sections 28 from the path which is defined by the transporting unit 4 does not result in the formation of a gap which could result in misalignment of some cigarettes in the region of the plane of the sections 28.

Since the regulating unit 41 has one or more inputs which are connected with the processing machine 44, the unit 43 can transit a signal to the drive means 26 for the conveyor 21 and rear wall 19, as well as to the drive means 42 for the removing conveyor means 6, when the processing machine 44 requires a fresh supply of cigarettes 8. The rear wall 19 then cooperates with the upper reach of the conveyor 21 to push (arrow 27) the mass flow 43 along the table 33 of the transporting unit 4, into the channel 37 and thence onto the belt conveyor 38 of the removing conveyor means 6. The drive means 26 for the conveyor 21 and rear wall 19 is operated as long and as frequently as is necessary in order to satisfy the requirements of the processing machine 44. Thus, the operation of the drive means 26 can be continuous or intermittent. The drive means 16 returns the elevator 11 to the solid-line position of FIG. 1 after the rear wall 19 reaches its foremost position 19*a* and all cigarettes are moved away from the platform of the elevator.

The drive means 26 automatically reverses the direction of movement of the conveyor 21 and rear wall 19 as soon as the rear wall reaches its foremost position 19*a* (indicated in FIG. 1 by phantom lines) in which it is adjacent the extended position of the front wall 18. The sections 28 of the front wall 18 reassume their extended positions before the conveyor 21 begins to move the wall 19 counter to the direction which is indicated by the arrow 27, i.e., back to the solid-line (rear end) position of FIG. 1. The wall 18 then props the rearmost portion of the mass flow 43 and the wall 19 moves away from the wall 18 in order to provide room for lowering of a fresh array of cigarettes 8 into the compartment of the magazine 3.

In order to guarantee a disturbance-free operation of the improved apparatus, it is desirable to ensure that the height of the mass flow 43 on the table 33 of the transporting unit 4 equal or closely approximate the height of the array of cigarettes 8 in the compartment of the magazine 3. This ensures that the cigarettes which are adjacent the plane of the front wall 18 will not roll forwardly or backwards when the wall 18 is moved to its retracted position. Any rolling of cigarettes 8 between two different levels, especially between two greatly different levels, could cause the articles to lie askew or to assume other undesirable positions which could interfere with their transport into the processing machine 44 and/or with their processing in such machine. To this end, the regulating unit 41 arrests the drive means 42 for the removing conveyor means 6 when the sensor 36 of the monitoring means for cigarettes 8 on the table 33 reaches the solid-line position of FIG. 1. In other words, cigarettes 8 which happen to be located in the channel 37 cease to move sideways (in the direction of arrow 27) because any further transfer of cigarettes from the table 33 onto the conveyor means 6 would result in a lowering of the level of the uppermost layer of the mass flow 43 on the table 33 so that the topmost cigarettes 8 of an array in the compartment of the magazine 3 would tend to roll downwardly onto the topmost layer of cigarettes on the table 33 in immediate response to retraction of the front wall 18. The regulating unit 41 then transmits a signal to the means (not shown) for extracting the bottom 9 of the tray 7 which is located at the evacuating station 2 and to the drive means 16 to lower the elevator 11 and the array thereon so that the front wall 18 can be retracted and the rear wall 19 thereupon moved forwardly simultaneously with renewed starting of the drive means 42 for the removing conveyor means 6. The sensor 36 is pivoted in a clockwise direction (as seen in FIG. 1) as soon as the rear wall 19 begins to move forwardly toward the position 19*a*, and the monitoring means including the sensor 36 then transits a signal which enables the regulating unit 41 to start the drive means 42 for the removing conveyor means 6.

When the sensor 36 reaches the position which is shown in FIG. 1 by phantom lines, this indicates that the requirements of the processing machine 44 are low or zero. The corresponding signal from the monitoring means is processed by the regulating unit 41 which then arrests or reduces the speed of the drive means 26 for the conveyor 21 and rear wall 19. It can be said that the table 33 and the sensor 36 together form an auxiliary magazine or buffer for storage of a certain quantity of cigarettes 8 which can be transported to the processing machine 44 during the interval which is required for replacement of an empty tray 7 at the evacuating station 2 with a fresh (loaded) tray. Thus, the apparatus can satisfy the requirements of the processing machine 44 without any interruptions, i.e., even at such times when the evacuating station 2 is in the process of being relieved of an empty tray 7 in order to provide room for a fresh tray.

It has been found that the placing of the pivot 34 for the sensor 36 close to its lowermost portion (i.e., adjacent the channel 37) contributes significantly to reliability of the illustrated monitoring means, i.e., of a monitoring means which not only ascertains the quantity of cigarettes on the table 33 but also cooperates with the table to store a supply of cigarettes for transport to the processing machine 44 during those intervals when the conveyor 21 is idle.

It is clear that the stationary table 33 can be replaced with a conveyor (e.g., an endless belt conveyor) which is driven in synchronism with the conveyor 21 (while the conveyor 21 moves its upper reach in the direction of arrow 27). However, the illustrated transporting unit 4 has been found to be quite satisfactory in view of its simplicity, compactness and low cost.

The conveyor 21 cooperates with the walls 18 and 19 to transport arrays from the compartment of the magazine 3 onto the table 33 of the transporting unit 4 without unduly stressing (deforming and/or defacing) the cigarettes.

An important advantage of the improved apparatus is that it can advance arrays of cigarettes 8 or other rod-shaped articles of the tobacco processing industry from the tray evacuating station 2 and all the way onto the table 33 of the transporting unit 4 without any, or with negligible, shifting of the articles relative to each other. Such transport of arrays contributes to gentle treatment of the articles and greatly reduces the likelihood of misalignment of articles in the transporting unit, on the removing conveyor means 6 and/or in the processing machine 4. Therefore, the apparatus is highly unlikely to become clogged due to improper transport of the articles.

Another important advantage of the improved apparatus is that the front wall 18 performs the plural functions of properly confining one side of an array in the magazine 3, propping the rearmost articles of the mass flow 43 on the table 33 and ensuring that the freshly delivered array can be added to the trailing end of the existing mass flow without the development of any gaps between them. Minimal mechanical stressing of conveyed articles reduces the likelihood of malfunction of the processing machine 44 and of turning out large numbers of rejects. In addition, the improved apparatus is very simple, compact and its regulating unit 41 can be designed to automate the operation to a desired extent so as to ensure that the apparatus will satisfy the requirements of one or more highspeed processing machines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting successive individual arrays of parallel rod-shaped articles of the tobacco processing industry wherein each array has a predetermined height and length into a continuous mass flow, comprising a magazine having upright front and rear walls and a bottom wall defining with said front and rear walls a compartment having a length corresponding to said predetermined length and a height at least matching said predetermined height; elevator means movable between an upper position above and a lower position in the region of said bottom wall; means for delivering discrete arrays to said elevator means; transporting means for supporting the mass flow adjacent said front wall and for advancing the mass flow in a predetermined direction away from said magazine, said transporting means including said bottom wall and said rear wall being movable in synchronism with said transporting means; first drive means for moving said front wall relative to said transporting means substantially transversely of said direction between an extended position and a retracted position so that an array in said compartment constitutes the trailing end of the mass flow on said transporting means in response to movement of the front wall relative to said transporting means to said retracted position; and second drive means for moving said rear wall and said transporting means reciprocably in and counter to said direction independently of said front wall a distance substantially equal to said predetermined length.

2. The apparatus of claim 1, wherein said transporting means includes a circulating first conveyor in said magazine and a second conveyor outside of said magazine.

3. The apparatus of claim 2, wherein said second conveyor comprises a stationary table for the mass flow.

4. The apparatus of claim 2, further comprising signal generating means for monitoring the quantity of articles on said second conveyor.

5. The apparatus of claim 4, further comprising means for operating said first conveyor and said second drive means in response to signals from said monitoring means.

6. The apparatus of claim 4, further comprising means for operating said first drive means in response to signals from said monitoring means.

7. The apparatus of claim 4, further comprising means for operating said elevator means in response to signals from said monitoring means.

8. The apparatus of claim 4, further comprising a removing conveyor arranged to receive articles of the mass flow from said transporting means, and means for operating said removing conveyor in response to signals from said monitoring means.

9. The apparatus of claim 2, wherein said second drive means comprises means for moving said rear wall in parallelism with the direction of transport of articles by said first conveyor.

10. The apparatus of claim 2, wherein said bottom wall forms part of said first conveyor.

11. The apparatus of claim 2, wherein said rear wall is mounted on said first conveyor.

12. The apparatus of claim 2, wherein said first conveyor includes an endless belt conveyor.

13. The apparatus of claim 1, wherein said first drive means includes means for pivoting said front wall between said extended and retracted position.

14. The apparatus of claim 1, further comprising means for regulating the operation of said elevator means, said drive means and said transporting means in a predetermined sequence so that said first drive means moves the front wall to said retracted position when the elevator means and an array thereon assume said lower position and that said transporting means thereupon advances the array from said compartment simultaneously with the operation of said second drive means to move the rear wall in said direction and to thereupon move the rear wall counter to said direction after the rear wall reaches a foremost position adjacent the extended position of said front wall.

15. The apparatus of claim 14, wherein said regulating means further comprises means for operating said first drive means to return said front wall to the extended position when the rear wall reaches said foremost position.

16. The apparatus of claim 1, wherein said delivering means includes trays having retractible bottoms so that an array on a retractible bottom can be transferred onto said elevator means in response to retraction of the bottom in the upper position of the elevator means.

17. The apparatus of claim 1, wherein said delivering means includes invertible trays for arrays of rod-shaped articles.

* * * * *